US006978493B2

(12) United States Patent
Stanneck

(10) Patent No.: US 6,978,493 B2
(45) Date of Patent: Dec. 27, 2005

(54) POOL COVER DRAIN

(76) Inventor: Eric Stanneck, 21 Elizabeth Ave., Washington, NJ (US) 07882

( * ) Notice: Subject to any disclaimer, the term of this patent is extended or adjusted under 35 U.S.C. 154(b) by 0 days.

(21) Appl. No.: 10/974,448

(22) Filed: Oct. 27, 2004

(65) Prior Publication Data

US 2005/0055761 A1 Mar. 17, 2005

Related U.S. Application Data

(63) Continuation-in-part of application No. 10/634,361, filed on Aug. 6, 2003, now Pat. No. 6,817,042.

(51) Int. Cl.[7] ..... E04H 4/00
(52) U.S. Cl. ..... 4/498
(58) Field of Search ..... 4/498

(56) References Cited

U.S. PATENT DOCUMENTS

| | | | | |
|---|---|---|---|---|
| 2,614,717 | A | 10/1952 | Wiggins | 220/26 |
| 3,579,657 | A | 5/1971 | Gurrieri | 4/172.12 |
| 3,690,502 | A | 9/1972 | Guber, Jr. | 220/26 |
| 3,757,812 | A | 9/1973 | Duncan | 137/142 |
| 4,214,671 | A | 7/1980 | McKibbin et al. | 220/219 |
| 4,248,357 | A | 2/1981 | Stafford | 220/219 |
| 4,318,421 | A | 3/1982 | Ward | 137/135 |
| 4,561,134 | A | 12/1985 | Mathews et al. | 4/496 |
| 4,633,899 | A | 1/1987 | Lord | 137/357 |
| 4,819,681 | A | 4/1989 | Hodak | 137/1 |
| 4,830,040 | A | 5/1989 | Eng | 137/135 |
| 4,853,984 | A | 8/1989 | Celiano | 4/496 |
| 5,343,888 | A | 9/1994 | Stelzer | 137/135 |
| 5,802,629 | A | 9/1998 | Zietek | 4/498 |
| 5,946,743 | A | 9/1999 | Hashmi | 4/498 |
| 6,260,217 | B1 | 7/2001 | Loft, Jr. | 4/498 |
| 6,338,169 | B1 | 1/2002 | DeGarie | 4/498 |
| 6,357,964 | B1 | 3/2002 | DeGarie | 405/52 |
| 6,487,733 | B2 | 12/2002 | Bonelli et al. | 4/498 |
| 6,497,533 | B2 | 12/2002 | DeGarie | 405/52 |
| 6,817,042 | B1 * | 11/2004 | Stanneck | 4/498 |

* cited by examiner

*Primary Examiner*—Charles E. Phillips
(74) *Attorney, Agent, or Firm*—Ernest D. Buff & Associates, LLC; Ernest D. Buff; Dave Narasimhan

(57) ABSTRACT

A pool cover drain substantially completely drains collected rainwater without use of pumps or electrical hookups. The pool cover drain is non-centrally located in a pool cover. It is attached to a flexible hose that directs the water to a swimming pool sidewall drain outlet. A weighted tubular element creates a conical depression in said swimming pool cover. The weighted tubular element is placed atop the pool cover in close proximity to said pool cover drain. Collected rainwater is directed along the outside and, optionally, the inside walls of the weighted tubular element, and into the pool cover drain. Angled weighted projections are located on an end of the weighted tubular element proximate the pool cover drain to facilitate gravity feed of collected rainwater into the pool cover drain. These angled weighted projections are weighted by filling the projection tube with sand, or optionally without sand by slotting the projection tube and allowing rainwater to collect therein and act as a weight. The weighted tubular element is provided with T type projections opposite to the angled weighted projections to prevent rolling and displacement of the weighted tubular element during high velocity wind gusts. A filter in the pool cover drain prevents clogging by debris and the like.

15 Claims, 5 Drawing Sheets

SECTION XX

POOL COVER DRAIN

This is a Continuation-In-Part of application Ser. No. 10/634,361, filed Aug. 6, 2003 Now U.S. Pat. No. 6,817,042, the disclosure of which is hereby incorporated in its entirety by reference thereto.

BACKGROUND OF THE INVENTION

1. Field of the Invention

The present invention relates to pool drains for above ground swimming pool covers; and more particularly, to an automatic drain that is easy to install, and functions with minimal hardware to effectively remove collected rain water and accumulated debris without stretching, straining or otherwise damaging the pool cover.

2. Description of the Prior Art

Many approaches have been proposed by prior art workers for removing rainwater accumulated over covers to container vessels, including swimming pools. Many of the swimming pool cover drains require electric motor driven pumps. Gasoline and other chemical storage vessels with closed tops drain the rainwater using gravity flow through the inside of a lattice of pipes to a common location from which the rainwater is drained.

U.S. Pat. No. 2,614,717 to Wiggins discloses a floating tank roof. This floating tank roof floats over the liquid in a tank and captures rainwater and snow without sinking. A central portion attached to rigid rings drains rainwater into the periphery of the roof surrounding the central rigid ring. A limber bottom as well as the weight of water collected in the central portion maintains the tapered bottom of the periphery. This taper allows the water to be gravity drained through a pipe connected to the periphery. Alternately, the central region may also have a drain connection. The floating tank roof disclosed by Wiggins does not drain all collected rainwater, and does not suggest features required for a pool cover drain.

U.S. Pat. No. 3,579,657 to Gurrieri discloses a swimming pool cover drain. The rainwater collected above the swimming pool cover is pumped through a filter with the same pump used to circulate the swimming pool water. A floating ball sensor determines when the swimming pool cover is pumped out. When the swimming pool cover is completely pumped a valve shuts the inlet allowing normal circulation of swimming pool water. The draining of collected rainwater requires the circulating pump to run. Separate valve hardware is required to prevent rainwater from entering the pool water.

U.S. Pat. No. 3,690,502 to Guber, Jr. (hereinafter, the "'502 patent") discloses a pipe containing an annular pontoon floating roof, which has high enough buoyancy to float on a hydrocarbon liquid surface in a tank. The edges of the annular pontoon seal against the tank sidewalls prevent entry of rainwater into the hydrocarbon tank. A central box channel provides structural rigidity to the annular pontoon and also acts as a draining element for collected rainwater collected, which increases the density of the pontoon and may submerge it below the surface of the hydrocarbon liquid. The collected water is drained through a flexible hose, which passes through the hydrocarbon liquid into a drain outlet located on the sidewall of the tank. The central box channel is connected to a parallel array of chordal pipes to provide additional structural rigidity. The annular pontoon roof disclosed by the '502 patent does not suggest a drain for swimming pool covers. The sealed floating pontoon moves according to the amount of rainwater collected, thereby presenting an arrangement that does not apply to swimming pool covers.

U.S. Pat. No. 3,757,812 to Duncan (hereinafter, the "'812 patent") discloses a roof standing water eliminator. It is installed in a low area in the roof. A float sensor detects accumulation of water and activates a pump. When the accumulated water is exhausted, the same float sensor shuts off the pump. The drainage system proposed by the '812 patent is not suitable for draining swimming pool covers. It requires a pump driven by an electrical motor that is turned on when sufficient rainwater is collected.

U.S. Pat. No. 4,214,671 to McKibbin et al. (hereinafter, the "'671 patent") discloses a floating roof drainage system. A central drain connects a plurality of welded pipes on the roof to drain accumulated rainwater. Sleeve type couplings provide a hinge-like motion between welded segments, so that the floating roof can be moved. The edge of the floating roof is sealed against the tank to prevent rainwater from entering the product stored in the tank. U.S. Pat. No. 4,248,357 to Stafford (hereinafter, the "'357 patent") discloses a floating roof drain. The floating roof edge is sealed against the tank wall by a seal strip. The floating roof collects rainwater and drains it through a central drain, which is connected to a coiled conduit connecting the central drain of the floating roof with a drain located in the bottom of the tank. When all the content of the tank is emptied, the floating roof essentially contacts the bottom of the tank and a frusto-conical contour of the bottom, together with a cylindrical portion, accommodates the central drain and the coiled conduit. The '671 and '357 patents disclose floating roof rainwater draining systems having sealed edges. Such systems are not suitable for use as a swimming pool cover drain.

U.S. Pat. No. 4,318,421 to Ward (hereinafter, the "'421 patent") discloses a float controlled siphon valve for a swimming pool cover. A hinged float is used to sense the water level and open a closure of a siphon inlet. The closure of the siphon is accomplished by a male opening and a female closure manufactured from a softer material, which moves away from the male member when the water level in the swimming pool cover rises. When the water level drops, the float moves downwards, forcing the female member over the male inlet creating a seal for the siphon system. The siphon system drains the accumulated rainwater over the pool cover by gravity without need of pumps, or the like. Drainage of water accumulated over the swimming pool cover is incomplete, since the float must remain primed at all times, and closes the valve before all the collected rainwater has been drained. Moreover, moving parts in the '421 patent system may become clogged with debris accumulated over the swimming pool cover.

U.S. Pat. No. 4,819,681 to Hodak discloses an apparatus and method for draining a swimming pool cover. A central drainage passage in a completely covered swimming pool cover is associated with upper and lower flanged members, which seal around a hole formed in the pool cover. The drain is connected to an elbow, which connects to a drain outlet located in a sidewall of the swimming pool. A flexible bellowed connection associated with the elbow accommodates the vertical motion of the water level or the swimming pool cover. A fixed rainwater liquid level is maintained above the pool cover to assure that the pool cover stays in place. This is accomplished by locating the drainage hole adjustably above the swimming pool cover. At all times, the level of rainwater is maintained above the swimming pool cover at a preset level by adjusting the position of the central drainage hole above the pool cover. A single central hole in the pool cover coupled with a large head of rainwater stresses the polymeric material of the swimming pool cover. This stress may enlarge the large central hole by tearing. Alternatively, the weight of rainwater above the swimming pool cover may tear the polymeric pool cover at the edges where it is attached. Excessive rainwater weight may also cause the swimming pool cover to become submerged beneath the water level in the pool.

U.S. Pat. No. 4,830,040 to Eng discloses an automatic swimming pool cover drainer. A float connected to a lever arm opens an inlet to a siphon valve and quickly closes when the water level reaches a preset value. Drainage of the water in the siphon exit line is thereby prevented so that the siphon action is not broken. The siphon discharge line is always filled with water. Electrical or mechanical means may be used to reset a latch mechanism assisting siphon valve closure. Water is always present on the swimming pool cover. Consequently, the plastic material of the swimming pool cover has to bear the weight of water, together with the sensing and activating mechanisms of the automatic drainer. Moreover the device disclosed by the patent does not empty out the accumulated rainwater completely. Accumulated debris on the swimming pool cover may interfere with the lever mechanism and prevent the siphon from remaining in a primed condition.

U.S. Pat. No. 4,863,984 to Celiano discloses a system and method for maintaining a swimming pool cover drained of accumulated precipitation. A pump with its intake is disposed in the reservoir region above the swimming pool cover where the rainwater accumulates. The pump discharges the rainwater outside this region and has a fluid flow-monitoring sensor in the discharge line. A clock circuit turns on the pump for a 10-second period. If the flow sensor in the discharge tube detects rainwater, the pump stays on. When the flow switch no longer senses flow and shuts off, the pump is also turned off. An electrical motor and power line connections are required for operation of the system.

U.S. Pat. No. 5,802,629 to Zietek discloses a self-draining pool cover. The pool cover has a central aperture to which a drain fitting is connected. The pool cover is attached over the sides of the above ground swimming pool and the central drain fitting in the swimming pool cover is connected to a first hose, which drains the collected rainwater by creating a conical depression in the swimming pool cover. The first hose is placed within the swimming pool water and is connected to a second fitting attached to the sidewall of the swimming pool. A second hose connected to this second fitting external to the above ground swimming pool drains away the rainwater. In order for the central drain to drain the collected rainwater, a conical depression must first be created. This depression is created by taut attachment of the swimming pool cover to the sides of the swimming pool and attachment of a hose disposed within the swimming pool water that is attached to a drain fitting in the sidewall of the swimming pool. The hose must be pulled taut to create the required conical depression. This results in high stress within the hose. A drain fitting proximate the hose pulls the plastic swimming pool cover; creating a large aperture in the plastic sheet, which can tear easily. Displacement of water due to the depression created within the swimming pool cover creates additional stresses thereon.

U.S. Pat. No. 5,946,743 to Hashmi discloses a self-draining pool cover. A central aperture in a swimming pool cover attached over the sides of a swimming pool is fitted with a collar to accept a hose. The collar is sealed water tight against the swimming pool cover by use of a rubber grommet. The hose connected to the collar drains the collected rainwater to the skimmer of the pool. This draining action requires that the collar be located at an elevated location, compared to the skimmer. Since the skimmer is at the same level as the general water level in the swimming pool, the pool cover has to essentially float above the water line. To achieve this floating action, the pool cover must be stretched taut. Inasmuch as the central aperture is a large opening, stretching of the pool cover can cause it to tear.

U.S. Pat. No. 6,260,217 to Loft, Jr. discloses a winter swimming pool cover and draining device. The swimming pool cover has a central aperture. A tube having slots in the upper portion is attached to the swimming pool cover using a threaded connection and gaskets to create a watertight seal between the tube and the swimming pool cover. The bottom of the tube is connected to an elbow which, in turn, is connected to a flexible hose conduit. The other end of the flexible hose conduit is attached to a sidewall of the above ground swimming pool below the water line. Rainwater drains through slots in the tube into the flexible hose conduit, and is discharged through a fitting attached to the sidewall of the pool. Since the tube is attached to the elbow and flexible hose conduit, it is not rigid. Consequently it is very difficult to locate and align the aperture of the swimming pool cover with the slotted tube. In addition, the threaded device with gasket must be tightened at the same time that the pool cover is attached firmly to the sidewalls of the aboveground swimming pool. The large aperture in the swimming pool cover may tear due to the stresses required by these multiple, complex, and unwieldy operations.

U.S. Pat. Nos. 6,338,169, 6,357,964 and 6,497,533 to DeGarie disclose a floating cover for large reservoirs. Means are provided for covering the top free surface of the liquid and for accommodating the up and down motion of the top surface according to the liquid level within the reservoir. A floating grid is anchored to the perimeters of the walls of the reservoir. The grid floats over the liquid surface due to its buoyancy. A water impermeable membrane is affixed to the perimeter walls and is loosely laid over the floating grid. An array of weights anchored to the wall is placed over the water impermeable membrane in between the free spaces of grid beams. Accumulated rainwater behaves in a fashion similar to the weights, and keeps the membrane taut. Drain holes at many locations are provided in the water impermeable membrane for draining collected rainwater through interconnected fittings, which terminate via a common drain. Side to side movement is anticipated for the perimeter-anchored membrane, as the liquid level in the reservoir is changed. This movement may interfere with beam and weight locations, snagging the drain holes and the drain connections with the beam. The disclosure does not elaborate how the drain holes function when the liquid level is changed. Any rainwater creates 'puddles', which tend not to create a well-formed valley located near the drain holes. No disclosure is contained by these patents concerning a drain for pool covers.

U.S. Pat. No. 6,487,733 to Bonelli et al discloses a self-draining swimming pool cover. The swimming pool cover consists of two layers. A top layer, which is a screen portion, prevents entry of debris. The bottom layer is the swimming pool cover. The bottom layer has a central aperture through which a drain fitting is attached. The drain fitting has a gasket, which seals the swimming pool cover against the fitting. The drain fitting is attached to a conduit, which may be a flexible hose, submerged in the swimming pool water connected to a drain fitting attached to a sidewall of an above ground swimming pool. A buoyant ring having a circular cross section joins the top and bottom layers, acting as a barrier. The single aperture is a large hole, so that stretching of the swimming pool cover applies stresses that may tear the central aperture. The buoyant ring prevents formation of a depression at the drain unless the drain physically pulls down the bottom layer; and this cannot readily occur, since the conduit is flexible. If the screen is taut, the bottom layer simply floats above the water level carrying the drain.

There remains a need in the art for a low cost, reliable, easy to use pool cover drain that is easy to attach and drains the collected rainwater completely as soon as it is collected without use of pumps, motors and electrical hook ups. The device must drain the collected rainwater completely, since any accumulation of rainwater applies stress to the polymeric pool cover sheet and will lead to eventual tearing of the pool cover.

SUMMARY OF THE INVENTION

The present invention provides a pool cover drain that is inexpensive to manufacture, easy to install and maintain, and highly reliable in operation. It can be installed at any time as long as the pool water is not frozen, and is readily adapted to facilitate drainage of an existing pool cover. The pool cover drain of the present invention readily collects substantially all rainwater deposited on the pool cover surface and channels the collected water away from the pool cover without use of pumps, motors and electrical hook ups. Substantially complete drainage of water and debris atop the pool cover is achieved without application of undue stress to the polymeric pool cover sheet; tearing and undue stretching of the pool cover is virtually eliminated.

Generally stated, a single drain is located in the pool cover. The drain is displaced approximately two to three feet from the pool filter water port. The drain has a screwed in elbow with a barbed nipple to which a flexible hose is attached. When the pool cover is installed, the other side of the flexible hose is connected to the sidewall water port of the swimming pool, and functions as a drainpipe to facilitate removal of collected rainwater through the swimming pool sidewall water port. The polymeric pool cover is placed over and attached to the swimming pool sides in the usual manner. A weighted tubular element is a double Y construction with straight segments of tubular elements connected to the central part of the double Y. The weighted tubular element has angled weighted projections connected to the side members of the double Y. The first tubular element of the straight segment is slotted to receive rainwater providing weighting functionality. The slots, as defined herewith, may be rectangular slots, circular openings, or openings of any shape or size. The side angled weighted projections of the weighted tubular elements are preferably weighted by sand on one side, or alternatively contain no sand and are weighted by rainwater. In the rainwater-weighted embodiment, the angled weighted projections have water permeable slots so that water enters the tubular elements as water accumulates on the pool cover. When the angled weighted projections' tubular elements fill with water they become weighted down and depress the pool cover, thereby increasing the puddle effect on the pool cover. These angled weighted projections are placed in close proximity to the pool cover drain. The weighted tubular element depresses the pool cover, creating a conical depression that enables collected rainwater to readily run downwardly adjacent the sealed tubular element and, optionally, through interior portions thereof, and into the drain. All the tubular elements of the weighted tubular element are attached to each other via mechanical attachment means, such as by friction or by screw connection.

The double Y element may be manufactured with an angle between the central straight tubular attachment and weighted side attachment, of approximately 45 degrees. The angle degree and length of the weighted side attachments utilized determine how the weight is distributed on the pool cover. Smaller diameter pool covers may, optionally, use shorter weighted side attachments or a narrower double Y angle to focus the weighted double Y element in the vicinity of the pool cover drain. For larger diameter pool covers, the weighted side attachments are lengthened to help hold down and stabilize the pool cover during windy conditions, and to draw water toward the drain.

Due to the displaced location of the drain in the pool cover and the conical depression caused by the use of the weighted tubular element, substantially all collected rainwater is rapidly removed, even in heavy rain downpours. Angled sand-filled protrusions at one end of the weighted tubular element may be used advantageously to prevent rolling of the tubular element over the pool cover, especially during heavy wind gusts. Optionally, a filter may be placed over the pool cover drain to prevent clogging thereof by leaves, branches, lawn clippings and other garden debris.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The present invention provides a pool cover drain that is installed with minimal hardware and effectively drains any collected rainwater completely. The pool cover drain drains rainwater completely, even in heavy rain downpours, so that rainwater does not accumulate over the swimming pool cover and cause stress. The stress to the polymeric sheet of pool cover is greatly reduced preventing tears, and thereby enhancing pool cover service life. A single drain nipple is provided on the polymeric swimming pool cover at a distance of approximately two to three feet from the pool filter water port. A flexible hose has one end attached to the barbed nipple of the pool cover drain and the other end of the hose is attached to a drain on the sidewall of the above ground swimming pool when the swimming pool cover is placed over the swimming pool. Next, the edges of the pool cover with the attached pool cover drain and flexible hose connection is firmly placed and anchored over the sides of the above ground swimming pool in the usual manner. A weighted tubular element having its weight placed primarily on one end is placed so that the weighted end is in close proximity with the pool cover drain. This depresses the pool cover into a conical depression, directing the collected rainwater into the pool cover drain. When rainwater is collected over the swimming pool cover, it runs down the conical depression in the pool cover to the pool cover drain and the water travels on the outside of the weighted tubular element. Optionally the construction of the weighted tubular element may be such that the rainwater may flow through the center of the pipe as well. In a preferred embodiment, the sealed weighted tubular element may have angled protrusions on one end. The protrusions are filled with sand. Protrusions placed at an angular separation of approximately 90 degrees prevent the weighted tubular element from rolling even when wind gusts are present. The angled protrusions locate the sand filled, weighted end portions of the weighted tubular element in close proximity with the pool cover drain, enabling the system to maintain a proper rainwater-draining configuration. Due to the conical depression caused by the weighted tubular element, the rainwater readily runs down into the drain with minimal accumulation even during heavy rain downpours. Accumulation of rainwater over the swimming pool cover is substantially prevented; strains and tears in the polymeric pool covers are minimized and the in-service life of the pool cover is significantly increased.

Figure 1:
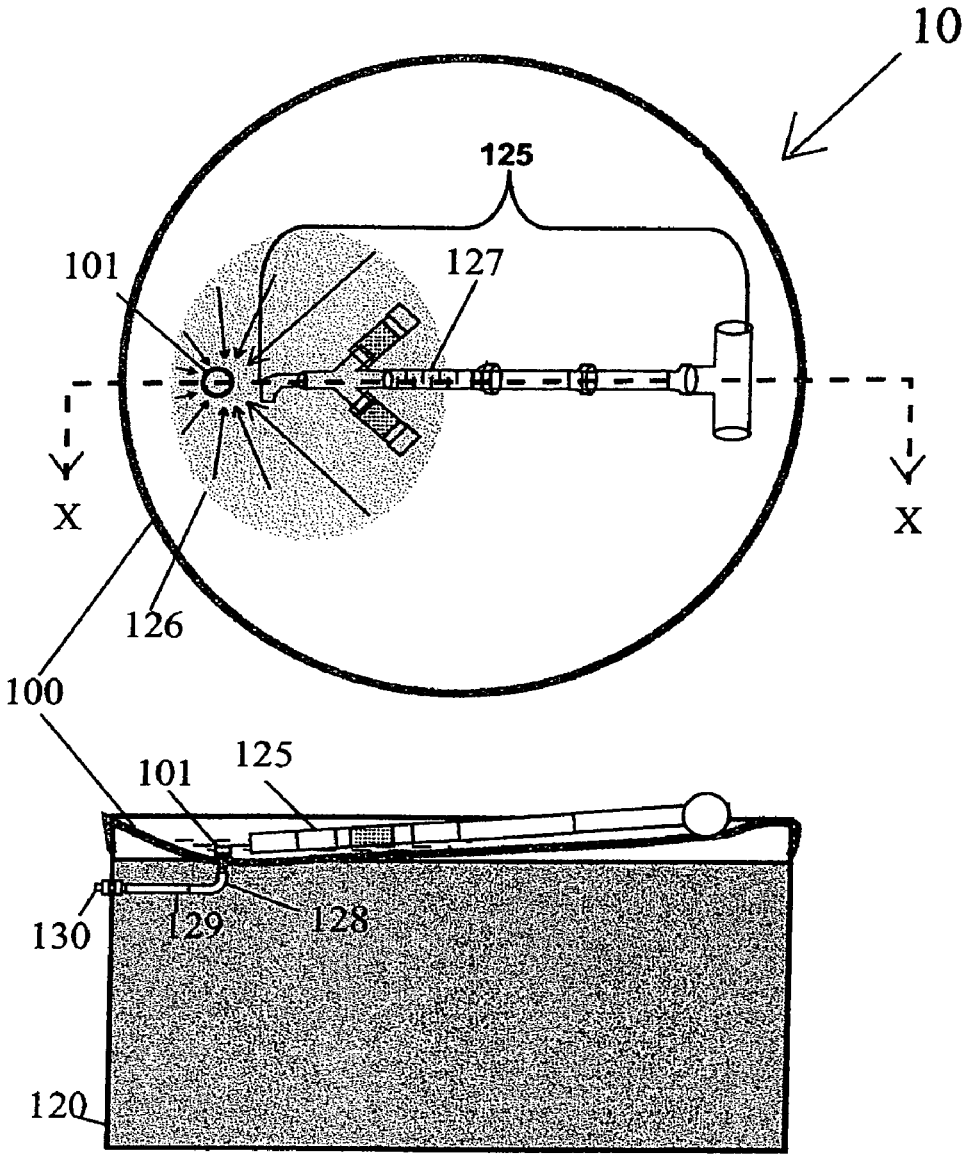
FIG. 1 is a schematic diagram of the pool cover drain with a pool cover placed over an above ground swimming pool showing drainage of the collected rainwater through an existing water outlet drain located in the sidewall of the pool well below the water line due to action of the weighted tubular element.

In FIG. 1 there is shown generally at 10 a schematic diagram of a pool cover having a section taken along the line XX. An above ground swimming pool 120 has a pool cover 100 placed over it, and carries a pool cover drain 101 in a non-centric location. The pool cover drain is located approximately two to three feet from the pool filter water port, as shown. When a pool cover is installed, an elbow 128 is attached to the pool cover drain 101 and the pool cover is placed over the sides of the swimming pool and anchored in the usual manner. The other end of the elbow 128 is connected to a flexible pipe 129 that is attached to a drain outlet 130 located on the sidewall of the swimming pool, well below the water line. When the pool cover is not in place, the water drain outlet 130 is capped or connected through external hosing to the pool filtering system (not shown) thereby preventing water from draining out of the swimming pool. FIG. 1 illustrates use of a weighted tubular element 125 with its two angular projections (see FIG. 2 at 105) carrying sand or slotted to bring in water for depressing the swimming pool cover to create a conical depression towards the drain as shown by the water line trace at 126. The first element of the weighted tubular element 125 is slotted at 127 so that water enters into the tube, thereby increasing its weight. As water drains out through the drain 101, the water that entered the weighted tubular element 125 is also drained. The angled weighted projects prevent rolling of the weighted tubular element in wind gusts. The angled weighted projects also act to keep the weighted tubular element on close proximity with the pool cover drain 101, thus maintaining the conical depression necessary for efficient draining of collected rainwater. The flow of collected rainwater to the drain 101 is indicated by arrows. Collected rainwater runs outside the weighted tubular element into the pool cover drain due to the conical depression formed in the pool cover 100.

Figure 2:
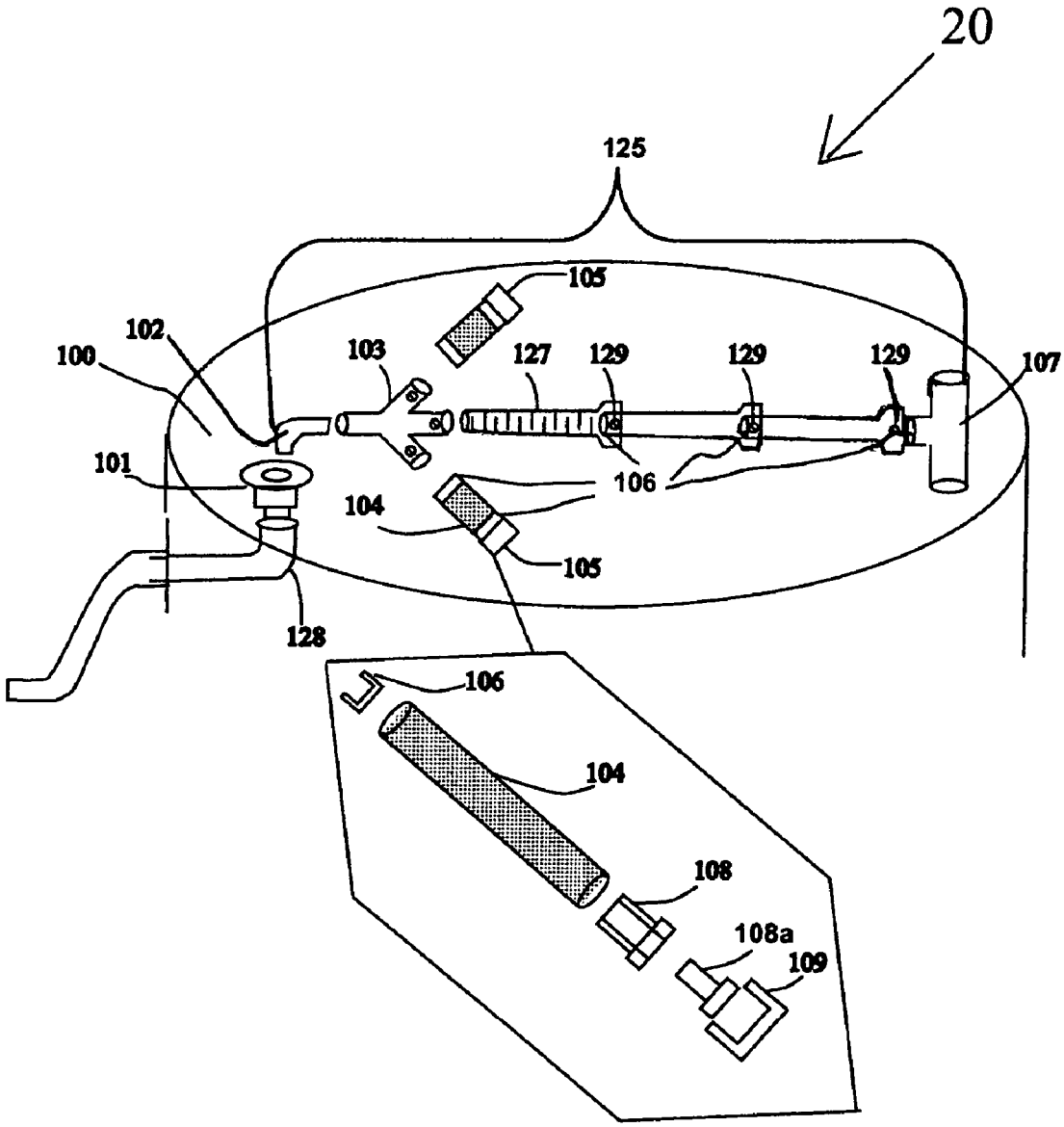
FIG. 2 is a schematic diagram depicting construction details for the weighted tubular element placed over the swimming pool cover.

In FIG. 2 there is shown at 20 the construction details for the weighted tubular element 125. The element 125 is composed of three sections of PVC tubing with internal plugs 106 and a T type tubular element section 107 joined together by friction or by use of retaining screws 129. The number of sections of PVC tubing can vary from as few as 2 to as many as 8 or more, depending on the pool size. There is a double Y element 103 opposed from the T type tubular element 107, having a central port and two side ports. PVC tube elements are connected to the central port of the double Y element 103, thereby forming a central element, with the first tubular element segment slotted as shown at 127 thereby allowing water to enter into the tube creating the weighting action. Each of the three tubular element segments shown is approximately 5 feet in length. Two angled weighted projections 105 are connected to the side ports of the double Y element 103. The double Y element 103 typically has an angular separation of 45 degrees between the central element and the angled weighted projections 105. These angled weighted projections 105 can be water tight and filled with sand, or can contain no sand and instead have water permeable slots (see FIG. 5). Construction details of the angled weighted projections 105 in the sand filled configuration are shown by FIG. 2 in the exploded view. The sand filled portion is a PVC tube approximately 2 feet long shown at 104 comprising a plug 106 on one side and a threaded plug with a central hole 108 on the other side to assist sand filling. When sand is filled, the central hole is also plugged with plug 108*a*, as shown, and the end is capped by cap 109. The central port of the double Y element 103 is further connected to a street elbow 102. When the angled weighted projections 105 contain sand the assembled weighted tubular element 125 is watertight except for the first element, which has water permeable slots shown at 127 and does not roll readily, due to the two angular projection elements 105, street-elbow 102, and T end cap 107. These angled weighted projections 105 provide sufficient weight, whether sand filled or without sand and with slots, to hold the tubular element 125 firmly against the top of pool cover 100, thereby enabling the system to maintain a proper rainwater-draining configuration.

Figure 3:
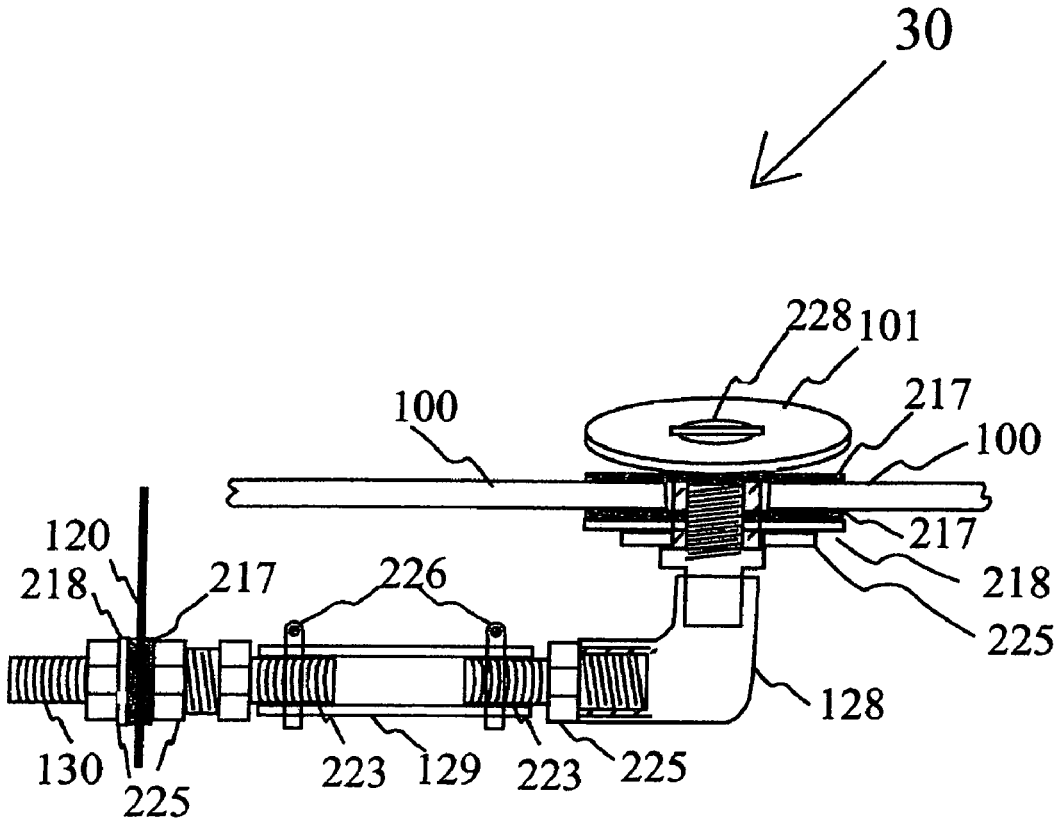
FIG. 3 is a schematic diagram depicting additional details of the pool cover drain, its attachment to the swimming pool cover, the attachment of the elbow to the drain, and attachment of the flexible hose connection to the sidewall of the swimming pool.

In FIG. 3 there is shown at 30 the details of the connection of the flexible hose 129 to pool cover drain 101 through an elbow 128 and its connection to the drain 130 on the sidewall of the above ground swimming pool. The pool cover drain may have a debris filter 228 installed on it to prevent entry of debris into the drain and may be in the form of fine wire mesh or a replaceable filter element. The swimming pool cover 100 has a hole to receive the pool cover drain 101. Two gaskets 217 are placed on either side of the pool cover, and a nut 225 is tightened against a washer 218 at the threaded end of drain 101 to create a waterproof seal. The threading of pool cover drain 101 is attached to an elbow at 128. The other end 225 of the elbow is connected to another barbed nipple 223, over which a flexible hose 129 is attached. Hose clamp 226 secures the hose 129. The other end of the hose 129 is attached to a nipple 223 attached to the sidewall of the swimming pool, and is held in place by hose clamp 226. The attachment of the drain outlet 130 to the swimming pool wall uses two gaskets 217 on either side of the sidewall of the swimming pool and nuts 225 and washer 218 to create a watertight seal. The drain outlet terminates outside the swimming pool on the sidewall at 130. All these connection elements may be made from standard PVC components and the flexible hoses may be rubber or other polymeric tubing.

Figure 4:
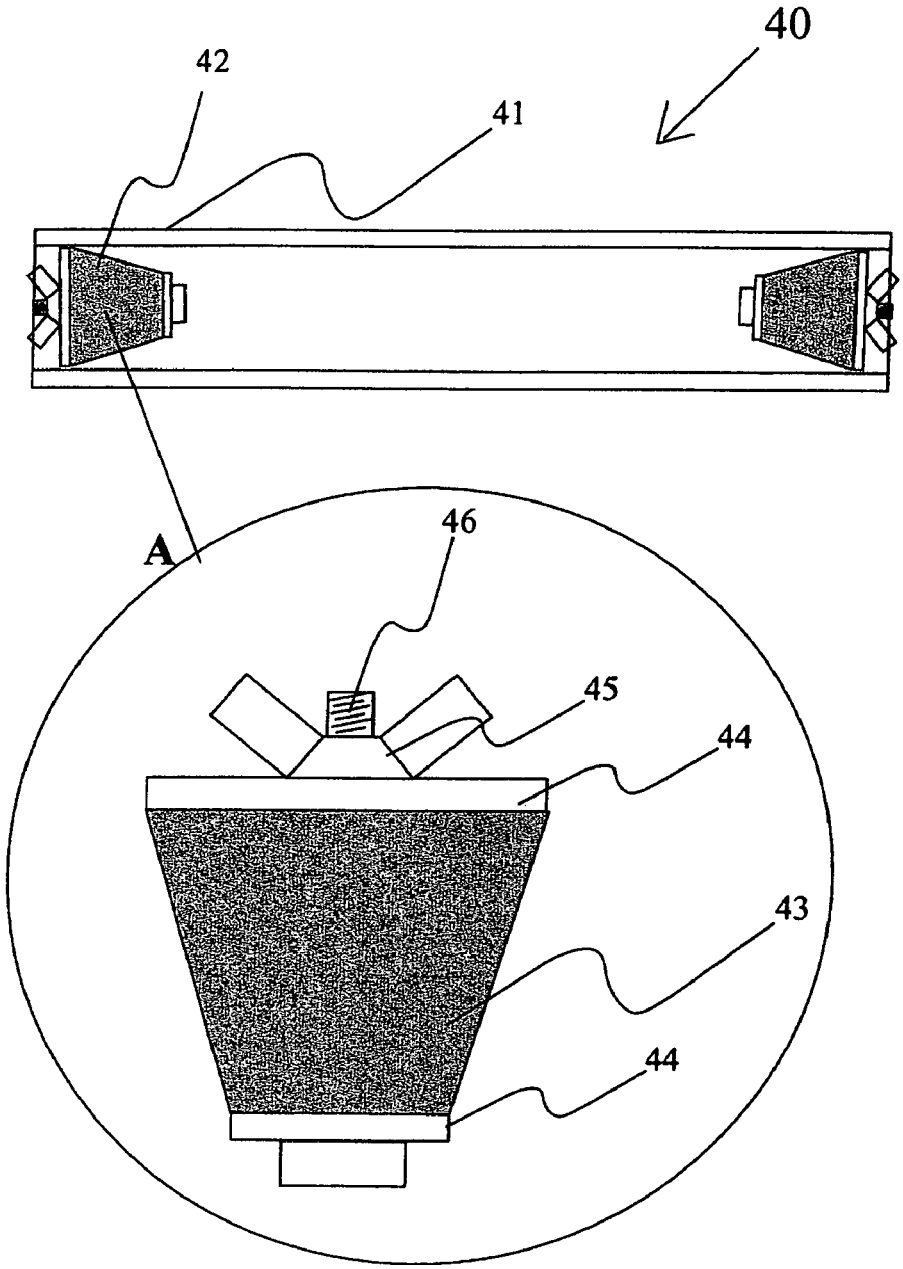
FIG. 4 is a schematic diagram depicting an alternate plugging arrangement to ensure that non-slotted tubular elements of the weighted tubular element are water tight.

In FIG. 4 there are shown at 40 the details of an alternate plugging arrangement to ensure that non-slotted tubular elements are watertight. The tube 41 has two easy to install expandable plugs 42 inserted on each end. This plugging arrangement is less expensive to construct than end plugs 106 illustrated in FIGS. 1 and 2. The details of the end plug 42 are illustrated in the expanded view. It has a rubber grommet 43, which is held between two washers 44. A central threaded bolt 46 tightens the grommet 43 as a wing nut 45 is turned. This plug is inserted into the PVC tubular element and the wing nuts are tightened to effect a watertight seal.

Figure 5:
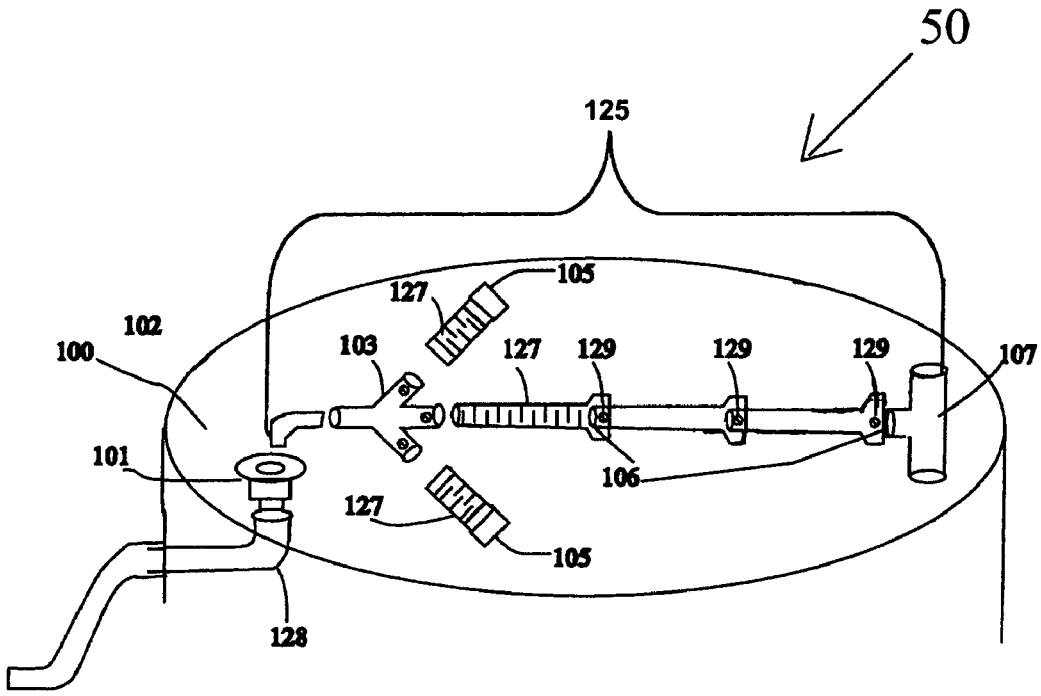
FIG. 5 is a schematic diagram depicting an arrangement for equipping tubular elements forming weighted projections that are angularly disposed with respect to a longitudinally disposed tubular element, with water permeable slots.

In FIG. 5 there are shown at 50 the details of the alternate arrangement of the angled weighted projections 105 where weighting is accomplished by utilizing water-permeating slots. In this arrangement, the side angled, weighted projections 105 forming tubular elements are slotted at 127 similar to the first tubular element attached to the central portion of the double Y element 103. Rainwater can enter into these tubular side elements of the angled weighted projections 105 as well as the first tubular element of the weighted tubular element 125, creating the weighting function. As rainwater drains away, the collected water in these angled, weighted projections 105 on the tubular slotted elements also drain completely through the slots.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A pool cover drain for an above ground swimming pool, comprising:

a. a pool cover placed over said above ground swimming pool having disposed in a non-centric portion thereof a, watertight pool cover drain;

b. attachment means for connecting a flexible hose to said pool cover drain and to a side wall drain in said swimming pool, for draining collected rainwater away from said pool cover;

c. weighted tubular element means disposed on said pool cover adjacent said water tight pool cover drain, forming a depression creation means for creating a conical depression in said pool cover with a low point contiguous to said pool cover drain to thereby direct collected rainwater on said pool cover along outside and, optionally, inside portions of said element means and into said pool cover drain;

d. said weighted tubular element comprising angled weighted projections on one end and straight segments forming a double Y configuration, said straight segments further comprising a first segment having slots to receive rain water providing a weighting function; and e. said weighted tubular element comprising a T type tubular element on the opposed end thereof to prevent rolling and displacement of said weighted tubular element over said pool cover.

2. A pool cover drain as recited by claim 1, wherein said pool cover is composed of a polymeric material.

3. A pool cover drain as recited by claim 1, wherein said pool has a substantially circular or oval shape and a pool filter water port, and said pool cover drain is disposed in said pool cover and displaced about 2 to 3 feet from said pool filter water port.

4. A pool cover drain as recited by claim 1, wherein said pool cover drain is attached to said pool cover with gaskets, a washer and a nut to create a water tight seal between said pool cover drain and said pool cover.

5. A pool cover drain as recited by claim 1, wherein said attachment means for connecting said flexible hose to said pool cover drain comprises a plurality of barbed fittings.

6. A pool cover drain as recited by claim 1, wherein said attachment means for connecting said flexible hose to said swimming pool sidewall drain comprises a plurality of barbed fittings.

7. A pool cover drain as recited by claim 1, wherein said depression creation means for creating a conical depression in said pool cover to direct rain water to said pool cover drain comprises a weighted tubular element having a weighted end, said weighted end placed in proximity with said pool cover drain.

8. A pool cover drain as recited by claim 1, further comprising a double Y element having a central opening and side openings, said weighted tubular element comprising straight polymeric tube segments attached to said central opening of said double Y element and said angled weighted projections attached to said side openings of said double Y element.

9. A pool cover drain as recited by claim 1, wherein said weighted tubular element comprises polymeric tubular elements attached to each other by mechanical means.

10. A pool cover drain as recited by claim 1, wherein said weighted tubular element comprises polymeric tubular elements attached to each other by friction.

11. A pool cover drain as recited by claim 1, wherein said weighted tubular element comprises polymeric tubular elements attached to each other by a screwed connection.

12. A pool cover drain as recited by claim 1, wherein said straight segments and said angled weighted projections are covered by end caps.

13. A pool cover drain as recited by claim 1, wherein said straight segments and said angled weighted projections are sealed by expandable end plugs.

14. A pool cover drain as recited by claim 1, wherein said weighted tubular element comprises sand contained in said angled weighted projections, providing weighting functionality.

15. A pool cover drain as recited by claim 1, wherein said weighted tubular element comprises slots in said angled weighted projections for allowing rain water to enter, providing weighting functionality.

* * * * *